US005303778A

United States Patent [19]

Vari

[11] Patent Number: 5,303,778

[45] Date of Patent: Apr. 19, 1994

[54] ON-OFF TYPE SPRINKLER

[76] Inventor: Peter Vari, 55 Kirkwood Dr., Newtown, Pa. 18940

[21] Appl. No.: 851,918

[22] Filed: Mar. 16, 1992

[51] Int. Cl.[5] ..... A62C 37/21

[52] U.S. Cl. ..... 169/90; 137/221; 251/44

[58] Field of Search ..... 169/90, 37, 19; 239/75; 251/44; 137/221

[56] References Cited

U.S. PATENT DOCUMENTS

| | | | |
|---|---|---|---|
| 3,757,866 | 9/1973 | Mears et al. | 169/37 |
| 3,791,450 | 2/1974 | Poitras | 169/37 |
| 3,802,510 | 4/1974 | Johnson | 169/19 |
| 3,848,676 | 11/1974 | Doherty, Jr. | 169/37 |
| 4,359,098 | 11/1982 | Johnson | 169/90 |
| 4,553,602 | 11/1985 | Pieczykolan | 169/19 |

*Primary Examiner*—David M. Mitchell
*Assistant Examiner*—Andrew C. Pike
*Attorney, Agent, or Firm*—Louis Weinstein

[57] ABSTRACT

In an automatic turn-off sprinkler, water enters an inlet and passes through a hollow interior region to the outlet. A reciprocating spool in the hollow region normally blocks the outlet enabling incoming water to fill a chamber above the spool. The gap between the ID of the bore and the OD of the spool permits sliding movement of the spool while providing a watertight seal preventing liquid entering the small opening communication with a chamber above the top of the spool from passing to the outlet opening. A heat sensor detects an emergency condition, unsealing a normally sealed opening allowing liquid pressing upon the spool to escape through the unsealed opening dropping the pressure on the top of the spool, whereby water pressure upon the bottom of the spool lifts the spool above the outlet. When the heat sensor seals the control opening, liquid pressure upon the top surface builds. Although pressure on the bottom and top surfaces is substantially equal, gravity urges the spool to the closed position which is maintained during normal conditions. The watertight seal is retained by controlling gap size, eliminating the need for O-ring seals which create undesirable frictional forces. The spool may be spherical or cylindrical. A light closing spring may be provided to normally urge the spool to the closed position. A plurality of on-off sprinkler devices may be controlled by a common heat sensor, if desired.

30 Claims, 11 Drawing Sheets

Fig. 4a
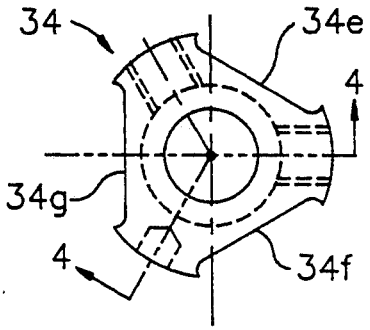
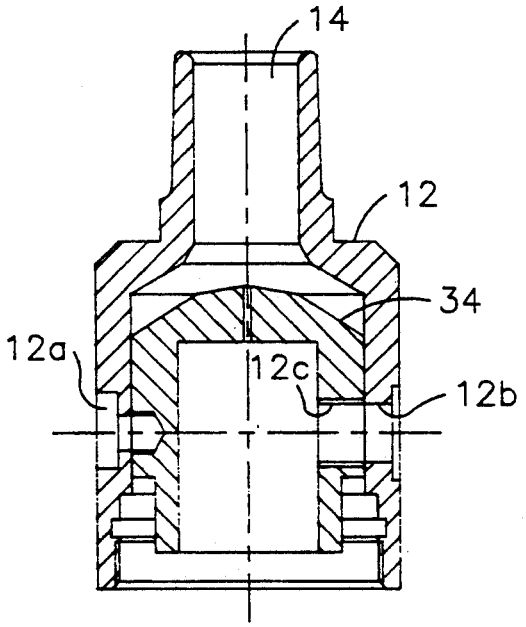
Fig. 3
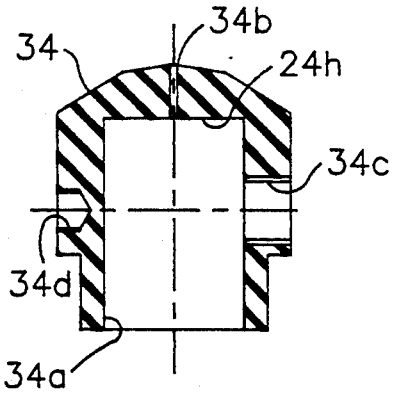
Fig. 4

*Fig. 5a*
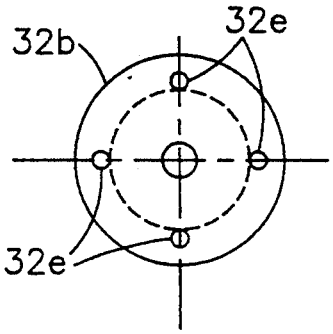
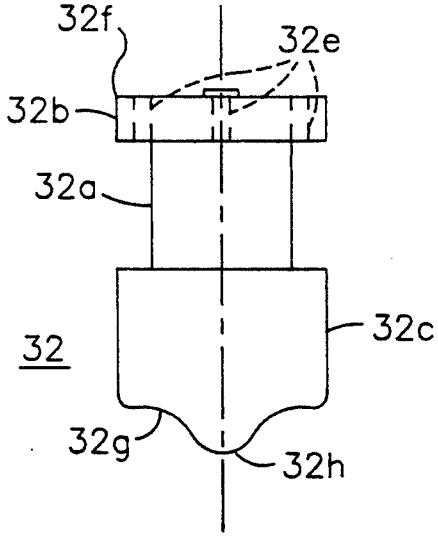
*Fig. 5*

*Fig. 6a*
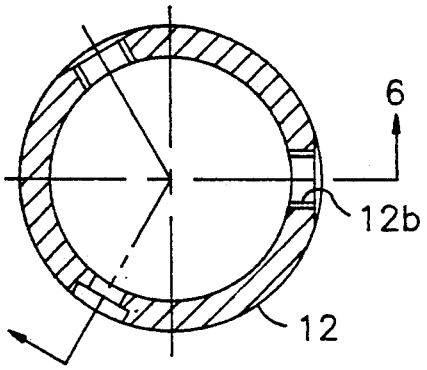
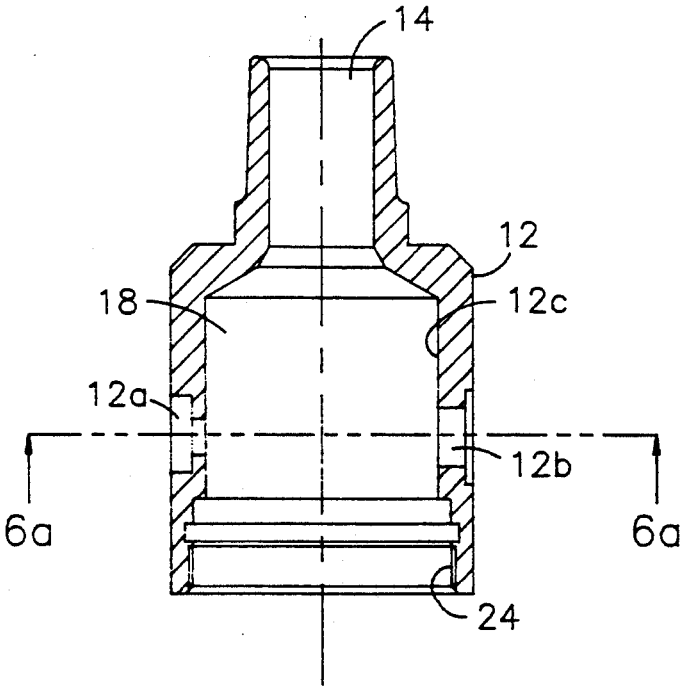
*Fig. 6*

*Fig. 11*
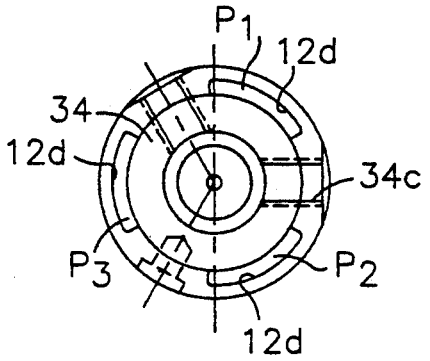
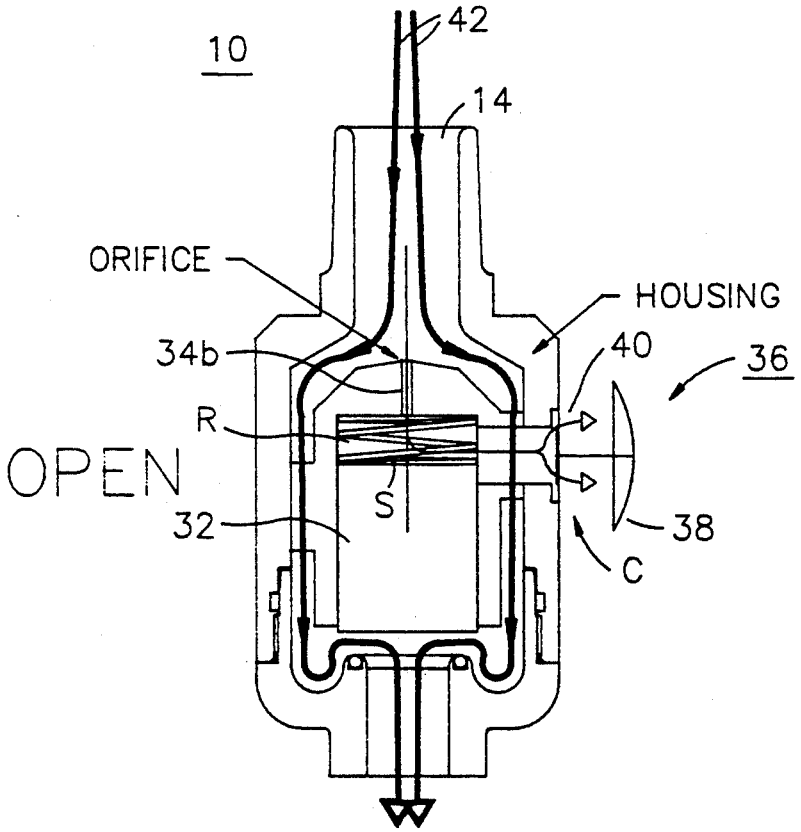
*Fig. 12*

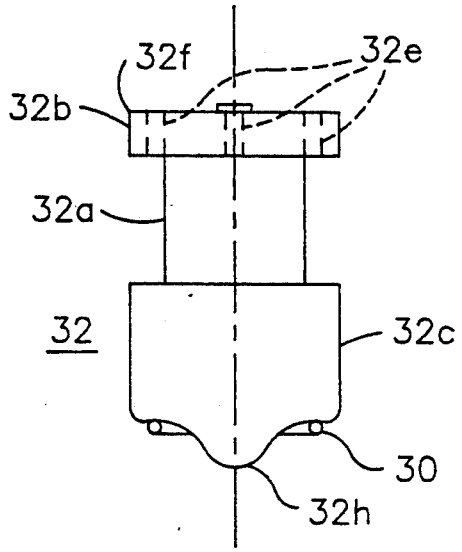
*Fig. 13*
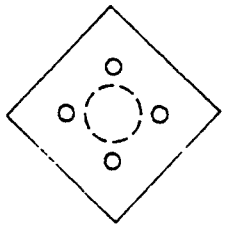
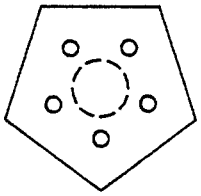
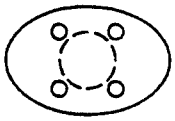
*Fig. 14a* *Fig. 14b* *Fig. 14c*

ON-OFF TYPE SPRINKLER

FIELD OF THE INVENTION

The present invention relates to sprinkler devices and, more particularly, to a unique on-off sprinkler device which has the capability of reclosing upon termination of an emergency condition and which employs a sliding seal which prevents the flow of water therethrough without the need for conventional sealing devices, such as O-rings, or the like.

BACKGROUND OF THE INVENTION

Sprinkler devices are well known and well accepted devices for protection of homes, offices, factories, and the like, against fire.

Conventional sprinkler devices typically utilize a heat-sensitive element which may, for example, melt at a predetermined temperature enabling a spring-loaded valve to open and spray water upon a predetermined area protected by the sprinkler device. Such devices have the disadvantage of remaining open and being incapable of reclosing due to destruction of the meltable element.

The need as well as the desire to provide sprinkler devices with an on-off capability have led to the development of sprinkler devices which have the capability of opening responsive to an emergency condition and reclosing when the emergency condition terminates. Note, for example, U.S. Pat. No. 3,757,866 which has a pilot valve actuated by a bimetal disk which normally biases the pilot valve to a closed condition, sealing a control opening communicating between a chamber in which a piston is reciprocatingly mounted and an outlet opening. Water enters through an inlet opening and passes through a restricted opening in the center of the piston to fill the aforementioned closed chamber whereby equal water pressure is applied on opposite surfaces of the piston but with the larger surface area of the piston confronting the closed chamber, the piston is urged to the closed position, sealing a second opening communicating between said inlet and said outlet.

The bimetal opens the valve to unseal the control opening when ambient temperature reaches a predetermined level such as 185° F. allowing water in the previously closed chamber to pass through the outlet opening abruptly dropping the pressure applied to the bottom surface of the piston enabling the piston to be moved to a position unsealing the opening between the inlet and outlet.

The valve reseals the control opening between the chamber and the outlet opening responsive to a reduced ambient temperature, typically of the order of 100° F., whereupon the chamber is refilled causing the liquid pressure build-up within the chamber to move the piston back to the position resealing the opening communicating the inlet with the outlet.

The above system, which is described in detail, for example, in U.S. Pat. No. 3,757,866, has a disadvantage of requiring O-ring sealing devices to prevent liquid filling the chamber from reaching the outlet opening, thus increasing the forces required to move the piston to both the sealed and the unsealed positions. The O-rings increase the force needed to move the piston. In addition, the useful operating life of the O-rings is limited, necessitating frequent maintenance and repair. For example, the average shelf life of an O-ring is of the order of fifteen years whereas the average life of a sprinkler device is of the order of fifty years. In addition, the shape of the piston necessitates the provision of two sliding chambers of different diameter for slidably mounting the piston.

Other sprinkler devices having on-off capabilities similar in design to the above-mentioned patent include: U.S. Pat. Nos. 3,698,483; 3,791,450; 3,802,510; 3,848,676; 4,553,602; 4,706,758; 4,830,117 and 4,830,118. The devices of all the above-mentioned patents have the disadvantage of requiring O-ring seals, as well as independent biasing members.

U.S. Pat. No. 4,359,098, in addition to requiring O-ring seals and biasing members, further requires a flexible diaphragm which is subject to wearing and deterioration at a rate equal to or greater than that experienced by the O-rings.

SUMMARY OF THE INVENTION

The present invention overcomes the disadvantages of the prior art by providing a device characterized by a design which provides an in-line control assembly having an intermediate region communicating the inlet of the device to the outlet and containing a reciprocating spool slidably mounted within said intermediate region and movable to a first position displaced from a spool seat surrounding the outlet and a second position engaging the spool seat to seal the outlet. An insert within said region slidably receives the spool and forms a top chamber between the top interior of the insert and the top surface of the spool which communicates with the inlet through a small diameter (i.e. "restricted") orifice.

Water entering the inlet passes through said orifice and through passageways provided between the insert and the interior region to apply pressure to the top and bottom surfaces of the spool. Although the pressure applied to the top and bottom surfaces of the spool are substantially equal, the force of gravity acting upon the spool urges the spool to said second position, sealing the outlet.

A valve controlled by a heat sensor selectively seals and unseals a control opening whose size (i.e. diameter) is significantly greater than the orifice opening in the insert. The control opening is unsealed responsive to a predetermined emergency condition allowing water in the top chamber to pass through the unsealed control opening at a rate faster than water can enter into the restricted opening within the insert thereby abruptly dropping the pressure within the top chamber substantially to zero whereupon the water pressure applied to the bottom surface of the spool displaces the spool from the seat surrounding the outlet to thereby spray the area served by the sprinkler device.

The control opening is reclosed when the emergency condition is terminated causing water entering the restricted opening in the insert to refill the top chamber. Although the pressure applied to the top and bottom surfaces of the spool is substantially equal, the orientation of the spool is such that a gravitational force urges the spool toward the second or closed position, resealing the outlet.

As an alternative embodiment, the spool may be provided with a top surface of greater surface area than the bottom surface to facilitate and enhance the closing operation and to facilitate maintaining the spool and hence the sprinkler device in the closed position. The opening operation is not affected by the modified spool.

Water in the top chamber is prevented from passing from the top chamber to the region surrounding the bottom surface of the spool and hence the outlet by controlling the gap region between the ID of the insert and the OD of the spool to a gap size which is sufficient to provide a watertight seal while enabling the spool to freely move between said first and second positions. This novel seal totally eliminates the need for conventional sliding seal members, such as O-rings, thereby eliminating the need for maintenance and replacement of such sliding seal members as is required in conventional sprinkler devices, as well as significantly reducing the frictional forces acting against the sliding movement of the spool. The novel, vertical, in-line arrangement of the spool takes advantage of gravitational forces, thus eliminating the need for conventional bias members, such as helical springs, or the like.

In an alternative embodiment, the spool may be either a cylindrical-shaped member or a spherical-shaped member.

In still another preferred embodiment, a sprinkler head assembly is mounted adjacent the outlet of the on-off sprinkler device and is provided with a blocking bar which blocks the spool (or ball) from sealing the outlet until the sprinkler device is actuated. This arrangement provides a fail-safe design in the event of a corrosion related failure of the on-off sprinkler device by assuring that the spool would be stuck in the open (i.e. fail-safe) position rather than the closed position.

In still another preferred embodiment, a plurality of on-off sprinkler devices may be controlled by a common heat sensor for controlling the selective sealing and unsealing of the control openings of the on-off sprinkler devices connected thereto to provide simultaneous, remote control of a plurality of on-off sprinkler devices by a single sensor mechanism.

OBJECTS OF THE INVENTION

It is, therefore, on object of the present invention to provide an on-off sprinkler device of a design making advantageous use of gravitational forces for closing control of the on-off device.

Still another object of the present invention is to provide an on-off sprinkler device which eliminates the need for conventional sliding seal devices, such as O-rings.

Still another object of the present invention is to provide an on-off sprinkler device having a design which significantly reduces the frictional drag imposed upon a reciprocating sealing component thus assuring movement of the sealing component to both the sealed and unsealed positions responsive to significantly reduced opening and closing forces as compared with conventional devices.

Still another object of the present invention is to provide an on-off sprinkler device which effectively eliminates the need for bias members required in conventional devices to control movement of a reciprocating member movable between on and off positions.

Still another object of the present invention is to provide an on-off sprinkler device having a simplified in-line arrangement between inlet and outlet in which a reciprocating member is employed to selectively seal the region between the inlet and the outlet.

Still another object of the invention is to provide an on-off sprinkler device having a reciprocally mounted spool which presents a greater surface area for a closing force than the surface area presented for an opening force thereby facilitating reclosing of the device.

Still another object of the present invention is to provide a remote control arrangement for simultaneously controlling the selective opening and closing of a plurality of on-off sprinkler devices through the use of a common heat-sensor-activated valve means.

BRIEF DESCRIPTION OF THE FIGURES

The above, as well as other objects of the present invention, will become apparent when reading the accompanying description and drawings in which:

FIG. 3 shows a sectional view of the housing and insert employed in the embodiment of FIG. 1 and looking in the direction of arrows 2, 2 in FIG. 1*a;*

FIG. 4 shows the sectional view of the insert of FIG. 3 removed from the housing of FIG. 3 and looking in the direction of arrows 4—4 of FIG. 4*a;*

FIG. 4*a* shows a top plan view of the insert;

FIG. 5 shows an elevational view of the spool employed in the embodiment of FIG. 1;

FIG. 5*a* shows a top plan view of the spool of FIG. 5;

FIG. 6 shows a sectional view of the housing employed in the embodiment of FIG. 1 and is a sectional view looking in the direction of arrows 6—6 of FIG. 6*a;*

FIG. 6*a* shows a sectional view of the housing of FIG. 6 looking in the direction of arrows 6*a*—6*a;*

FIG. 11 shows a schematic view similar to FIG. 1*a* and showing an alternative embodiment to that shown in FIG. 1*a;*

FIG. 12 shows a view similar to FIG. 7*a* and showing an alternative embodiment to that shown in FIG. 7*a;*

FIG. 13 is a view of the spool similar to the view shown in FIG. 5 and showing the embodiment of the spool; and FIGS. 14*a*, 14*b* and 14*c* show top views of alternative embodiments of the spool shown in FIG. 5*a*.

DETAILED DESCRIPTION OF THE INVENTION AND THE PREFERRED EMBODIMENTS THEREOF

Figure 1A:
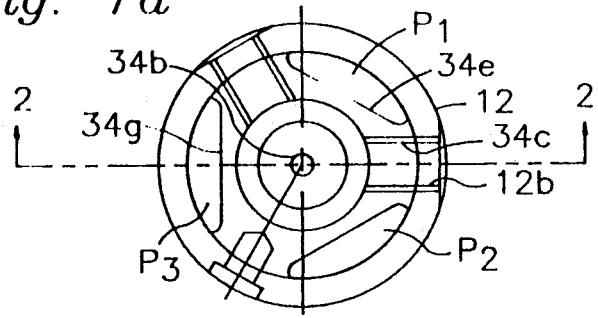
FIG. 1*a* shows a schematic view of the interior region of the embodiment of FIG. 1.
Figure 1:
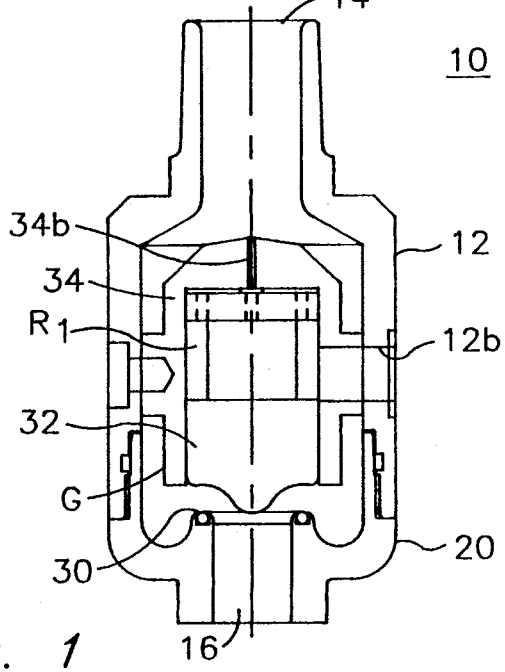
FIG. 1 is a schematic elevational view showing one preferred embodiment of the on-off device of the present invention.

FIGS. 1 and 1*a* show one preferred embodiment 10 of an on-off sprinkler device embodying the principals of the present invention and FIGS. 2–6*a* show views of the components employed in device 10. The on-off device 10 is comprised of a hollow housing 12 provided with inlet and outlet openings 14, 16 and a hollow interior region 18 intermediate the inlet and outlet openings 14 and 16. Inlet and outlet ends are respectively adapted for force-fitting, a threaded or soldered connection with a water source such as a pipe and a sprinkler spray device.

Figure 2:
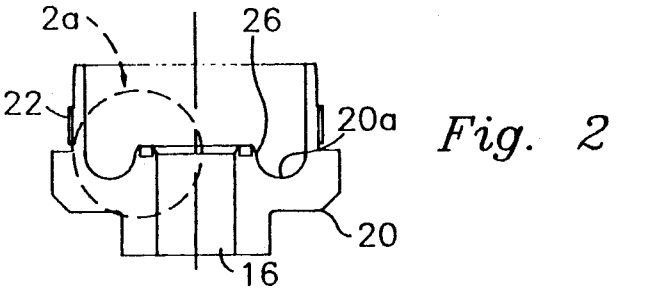
FIG. 2 shows an enlarged sectional view of the spool seat provided in the embodiment of FIG. 1 and looking in the direction of arrows 2—2 in FIG. 1*a;*
Figure 2A:
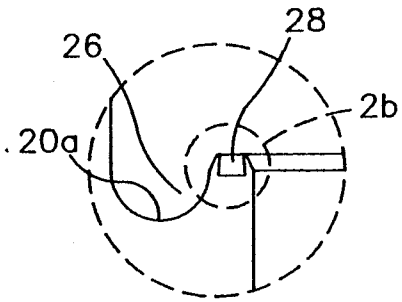
FIGS. 2*a* and 2*b* show enlarged, detailed sectional views of details of said valve seat, FIG. 2*a* being an enlargement of the region inside the dotted circle 2*a* of FIG. 2 and FIG. 2*b* being an enlargement of the region inside the dotted circle 2*b* of FIG. 2*a;*
Figure 2B:
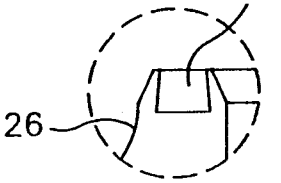

To simplify production, housing 12 is preferably formed of a first housing portion 12 shown in FIGS. 1 and 6, for example and an end cap 20 shown in FIG. 2 which contains outlet opening 16 and which is provided with a knurled surface 22 for force-fitting engagement or alternatively a threaded surface for threaded engagement with a tapped arrangement in the opening 24 in housing portion 12. The members 12 and 20 may be produced as one piece, if desired.

End cap 20 is further provided with an annular spool seat 26 having an annular recess 28 for receiving an O-ring 30 which aids in providing a liquid-tight seal between spool seat 26 and spool 32 shown in detail in FIGS. 2, 2*a*, 2*b*, 5 and 5*a*. Alternatively, the O-ring may be mounted on spool 32 as shown in dotted fashion in FIG. 5.

Spool 32 has a generally cylindrical shape and is provided with an annular recess 32*a* separating a top or head portion 32*b* from the bottom cylindrical portion 32*c* of diameters greater than recess 32*a*. Head portion 32*b* is provided with a plurality of small diameter openings 32*e* which provide liquid passageways between the top surface 32*f* of spool 32 and a control opening, as will be more fully described. Spool 32 may be formed of TEFLON (polytetrafluoroethylene), ceramic or other suitable plastic material to provide low friction, is corrosion resistant and to withstand high temperatures. FIGS. 14*b* and 14*c* show other peripheral configurations which may be employed as a substitute for the circular periphery of FIG. 5*a*. Spool 32 is slidably mounted within an insert 34 shown in detail in FIGS. 3, 4 and 4*a* which insert is provided with a hollow, substantially cylindrical opening 34*a* for slidably receiving spool 32, a vertically aligned opening 34*b* and a horizontally aligned opening 34*c*, openings 34*b* and 34*c* communicating with cylindrical opening 34*a*. A recess 34*d* cooperates with an opening 12*a* in housing 12 for receiving a fastening member which threadedly engages insert 34 to prevent insert 34 from experiencing either rotational or axial movement relative to housing 12. Opening 34*b* communicates with inlet 14. Opening 34*c* communicates with opening 12*b* in housing 12 as shown best in FIG. 3 to collectively form a control opening C.

Insert 34 makes a substantially tight fit within housing 12 and is provided with three longitudinal recesses or "flats" 34*e*, 34*f*, and 34*g* along the outer surface thereof which cooperate with the cylindrical-shaped inner periphery 12*c* of housing 12 (see FIG. 6) to define three passageways P1, P2, and P3 (see FIG. 1*a*) to guide the flow of water from inlet 14 through the aforementioned three passageways to the lower end of housing 12 for application of water pressure to the bottom surface of spool 32, as will be more fully described. If desired, housing 12 and insert 34 may be of a one-piece construction. As another alternative, the outer periphery of insert 34 may be cylindrical as shown in FIG. 11 and the inner periphery of housing 12 may be provided with recesses 12*d* shown in FIG. 11 to collectively define passageways similar to P1, P2 and P3. Spool 32 may also have a cross-sectional shape which is non-circular such as oblong, triangular, rectangular, square, polygonal, and the like, wherein the flat surfaces cooperate with the opening 34*a* in insert 34 having a conforming cross-section.

Figure 7A:
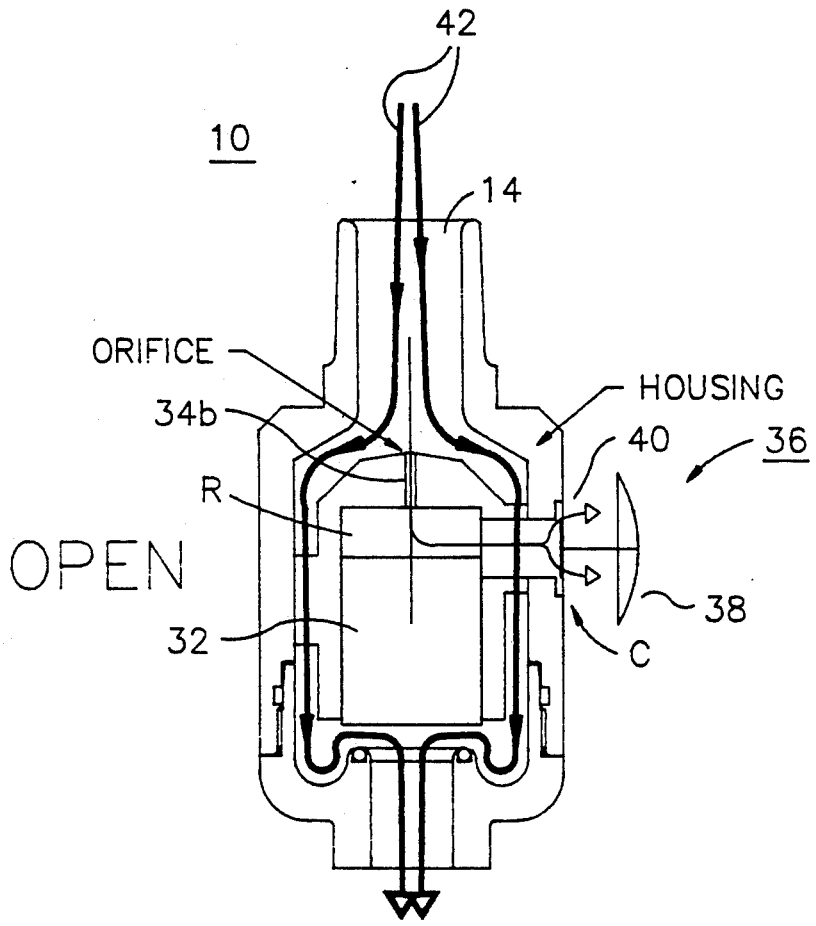
FIGS. 7*a* and 7*b* are diagrammatical views showing the embodiment of FIG. 1 and which are useful in describing the operation thereof.
Figure 7B:
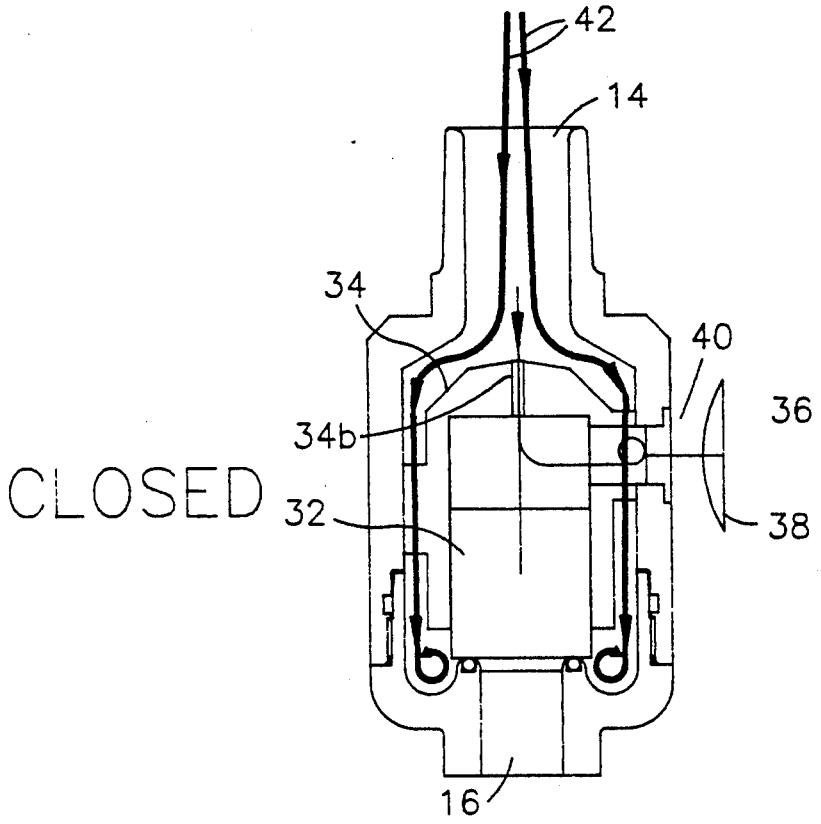

FIGS. 7*a* and 7*b* will now be considered in conjunction with FIGS. 1–6*a* in describing the operation of embodiment 10 of the present invention.

FIG. 7*a* shows the sprinkler device fitted with a heat sensor assembly 36 comprising a heat sensor 38 and a valve mechanism 40. The heat sensor may be any conventional heat sensor such as, for example, those described in U.S. Pat. Nos. 3,757,866; 3,848,676; and 4,553,602 which are utilized to operate valve assembly 40 to move between a first or closed position sealing control opening C comprised of cooperating openings 34*c*, 12*b* (see also FIG. 3). The heat sensor moves to a first state when the temperature is raised above a predetermined level, for example, 185° F., to open valve assembly 40. When the ambient temperature drops to a level, for example, 100° F., the heat sensor operates to close valve assembly 40. The valve assembly may be any conventional type, such as, for example, those disclosed in the aforementioned '866; '676 and '602 patents.

Assuming the ambient temperature to be below 185° F., heat sensor 38 moves valve assembly 40 to the closed state as shown in FIG. 7*b*. Water flowing into inlet 14, represented schematically by flow lines 42, flows into inlet 14, around the top of insert 34 and through the passageways P1, P2 and P3 (see FIG. 1*a*) defined by the interior periphery 12*c* of housing 12 and the recesses 34*e*, 34*f*, and 34*g* provided in insert 34 (see FIG. 4*a*). The water flowing through passageways P1–P3 enters into the bottom region of the housing, including the annular recess 20*a* provided in end cap 20 (see FIG. 2) and applies an upward force against the bottom surface 32*g* of spool 32 (see FIG. 5). Water entering inlet 14 also flows through constricted opening 34*b* in insert 34 and enters into the region between the roof 34*h* of interior cylindrical opening 34*a* (see FIG. 4) and the top surface 32*f* of spool 32. The water also flows through openings 32*e* in spool 32 and fills the region between annular recess 32*a* and the interior cylindrical opening 34*a* of insert 34 (see FIG. 4). The flow of water through the control opening is blocked due to the closure of the control opening C by valve assembly 40 under control of the heat sensor 38. As a result, the water fills the hollow region R as well as the hollow region R1 (see FIGS. 1 and 7*a*).

The forces applied to the top and bottom surfaces of spool 32 are substantially equal. However, the orientation of the assembly 10 and especially spool 32 makes advantageous use of gravitational forces which urge spool 32 downwardly to the closed position sealing outlet 16. The tapered bottom 32*h* of spool 32 facilitates proper guidance and alignment of spool 32 in the spool seat as well as guiding the flow of water about the spool and into outlet 16. The smoothly curved guide surface also minimizes turbulences in the water flow which changes direction in passing beneath spool 32 and into opening 16. Annular curved recess 20*a* (see FIGS. 2 and 2*a*) also aids in reducing turbulence of the water flow.

Water is prevented from entering into the gap space G (see FIG. 1) between the OD of spool 32 and the ID of insert cylindrical opening 34*a* by choice of a gap dimension which lies within the range of from 0.0001 to 0.003 inches, preventing water from flowing downwardly from regions R and R1 through the aforementioned gap space, thereby maintaining the aforementioned balanced condition of the forces applied to the upper and lower surfaces of spool 32, whereby the resultant effect of the gravitational force is to urge spool 12 downwardly and ultimately maintain device 10 in the closed position sealing outlet 16. The gap space G is shown as a line in FIG. 1 due to the small dimension of the gap space G. O-ring 30 enhances the liquid-tight seal between the bottom surface of spool 32 and the spool seat 26. If desired, the O-ring 30 may be mounted upon spool 32 as shown in FIG. 13.

When the spool 32 reaches O-ring 30 blocking the discharge opening, the pressure acting in the top chamber is applied to the full surface 32*f* of the spool while the same pressure acting at the bottom of the spool is applied upon a reduced ring-like surface, i.e. that surface which is outside of the periphery of O-ring 30, the result is a positive downward force to maintain the on-off sprinkler device 10 in the closed position.

The downward sliding movement of spool 32 is enhanced by the total elimination of sliding seal members, such as, O-rings, conventionally employed in the region between the OD of spool 32 and the ID of the insert cylindrical opening 34*a*. This force is reduced to a level of the order of less than 3 psi. By comparison, devices employing sliding seal members, such as, O-rings, have forces of the order of 10 psi. or more, typically requiring auxiliary biasing means, such as, for example, springs normally urging the spool to the closed position. If desired, spool 32 may be biased by a light spring force which is significantly less than that required in conventional devices. The spring location can preferably be between surfaces 32*f* and 34*h*. The spring may be a helical spring S shown in FIG. 12. The spring force is chosen so that, together with the gravitational force, it is, at maximum, no greater than minimum force of 3 psi. which conforms to the minimum opening force according to widely accepted safety standards.

When the ambient temperature reaches a level sufficient to indicate the need for emergency action, heat sensor 38 opens valve 40. The control opening C and the collective sizes of the openings 32*e* in the head portion 32*b* of spool 32 cause the water to be removed from regions R1 and R at a much more rapid rate than the entry of water through the constricted orifice 34*b* in insert 34 with the result that the pressure in region R drops to substantially zero whereby the force acting on the top of the spool is close to zero. The water acting on the bottom surface of the spool continues to be applied to the spool with the result that the bottom of the spool sees all the pressure causing a force acting upwardly on the spool. The spool moves upward thereby unsealing the outlet 16 allowing the water to pass through the outlet opening and thereby be sprayed upon a predetermined area beneath sprinkler device 10.

Figure 7D:
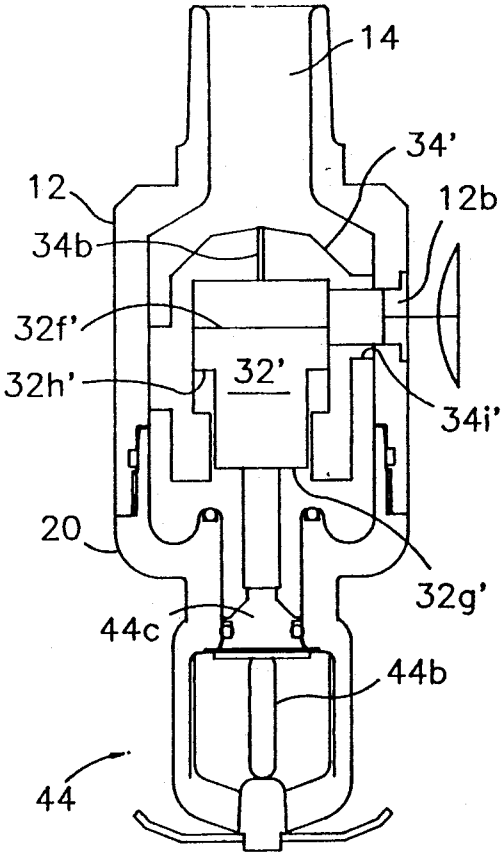
FIGS. 7*c* and 7*d* are diagrammatical views of still further embodiments of the present invention.
Figure 7C:
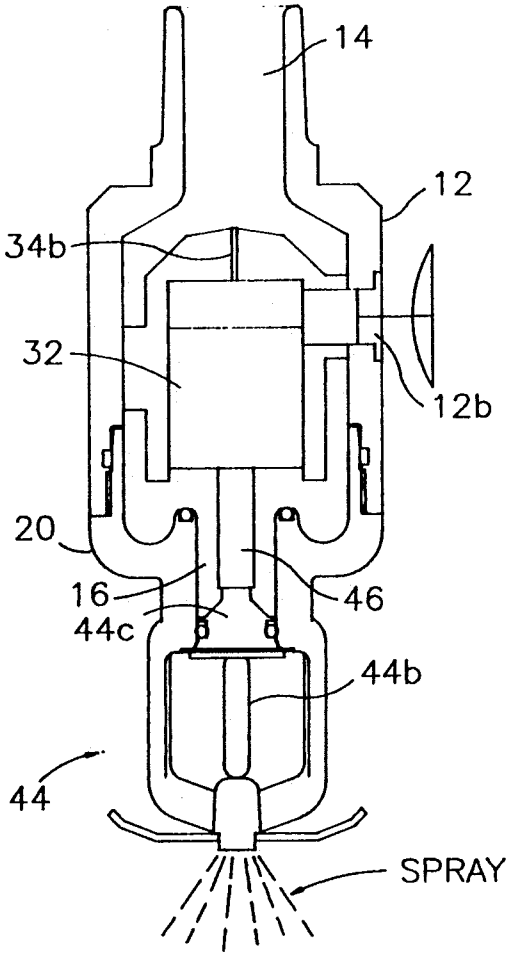

The sprinkler device is preferably fitted with a suitable sprinkler head 44 including a housing which is either integral with or secured to the end cap 20, as shown in FIGS. 7*c* and 7*d*. In a preferred embodiment, sprinkler head 44, which is designed to deflect the water flowing through outlet 16 into a spray of a predetermined pattern, cooperates with a space bar 46 which serves as a blocking piece to be discharged at the time of actuation. Space bar 46 prevents the spool from being seated until the sprinkler is actuated. This arrangement provides a fail-safe design as follows. If the on-off sprinkler device 10 should experience a corrosion or corrosion-related failure, the spool would be stuck in the open (fail-safe) position rather than the closed position. More specifically, assuming that spool 32 moves to the open position as shown in FIG. 7*c*, bar 46 is retained in the upper position as shown in FIG. 7*c* until sprinkler head 44 operates at which time bar 46 drops. A glass tube 44*b* filled with alcohol, breaks when an alarm temperature is reached and allows plug 44*c* beneath bar 46 to drop. As an alternative to bar 46, the tapered nose 32*h* of spool can be made longer as a substitute for the space bar. This arrangement prevents return movement of the spool 32 to the closed position until the sprinkler head 44 has operated, i.e. has sprayed water upon the surface protected by on-off sprinkler device 10 when the on-off device 10 is first opened.

FIG. 7*d* shows another embodiment of spool 32′ in which the top surface 32*f*′ is greater in surface area than the bottom surface 32*g*′. The upper portion of spool 32′ is of greater diameter than the lower portion forming a shoulder 32*h*′. The interior region of insert 34′ slidably receiving spool 32′ has an upper portion of larger diameter and a lower portion of smaller diameter defining a shoulder 34*i*′. Shoulder 32*h*′ moves to the proximity of shoulder 34*i*′ when spool 32′ is in the closed position, to assure a proper seal with the O-ring. The greater surface area of top surface 32*f*′ increases the closing force as compared with the embodiment of FIG. 7*c*, for example, enhancing the closing operation. The embodiment of FIG. 7*d* otherwise functions in a manner similar to the embodiment of FIG. 7*c*.

Figure 8:
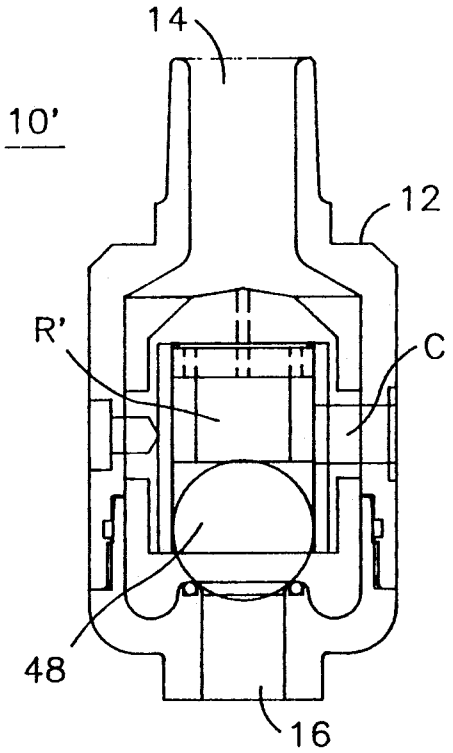
FIG. 8 is a diagrammatical view of a still further embodiment of the present invention.

FIG. 8 shows still another embodiment of the present invention wherein the spool 32 is replaced by a ball or spherical member 48. The operation of the device 10′ shown in FIG. 8 is otherwise the same as that described for the embodiment 10 with the exception that the ball does not require the flow openings 32*e* provided in spool head 32*b*. The ball, in the open position, does not seal control opening C and, when control opening C is unsealed, the water in the upper region R′ of FIG. 8 flows directly out of the control opening C (note that the region R′ has a larger volume than the region R in device 10).

Figure 9:
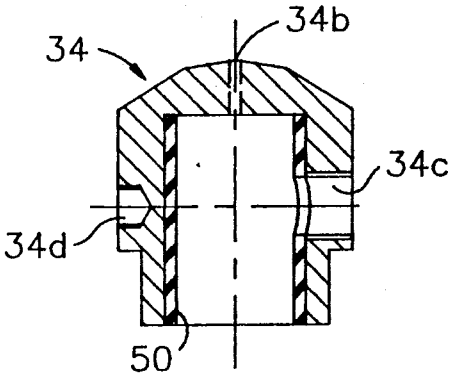
FIG. 9 is a cross-sectional view of another embodiment of the insert of the present invention similar to that shown in FIG. 4.

FIG. 9 shows an alternative arrangement for insert 34 which is provided with a cylindrical bushing formed of a suitable material having a low coefficient of sliding friction, such as, for example, TEFLON (polytetrafluoroethylene). Alternatively, the bushing may be formed of a ceramic or other suitable plastic material as shown in FIG. 4 to provide low friction, corrosion resistance and to withstand high temperature. Bushing 50 provides the following function. Due to the close tolerances of the sliding components 32 and 34, the components, which in one preferred embodiment may be formed of brass, are susceptible to the development of a corrosion problem. By providing a surface having a low coefficient of sliding friction so that spool 32 contacts the bushing 50, corrosion and other related problems are eliminated. Also, the use of a spool (or ball) having a constant outer diameter which acts as a sealing surface, permits the use of an insert or bushing having a constant ID for slidably receiving the spool (or ball).

In the alternative embodiment 10′ shown in FIG. 8, the ball 48 may be formed of brass or alternatively, may be formed of TEFLON (polytetrafluoroethylene)-thereby providing engaging sliding surfaces (ball 48 and insert 34) of metal and low friction plastic, thereby eliminating the need for the bushing 50 employed in the embodiment 10'.

When employing the bushing 50, it should be understood that the gap space between the spool 32 (or ball 48) and the ID of bushing 50 is designed to be within the same gap space range set forth hereinabove, namely, 0.0001 to 0.003 inches.

Figure 10:
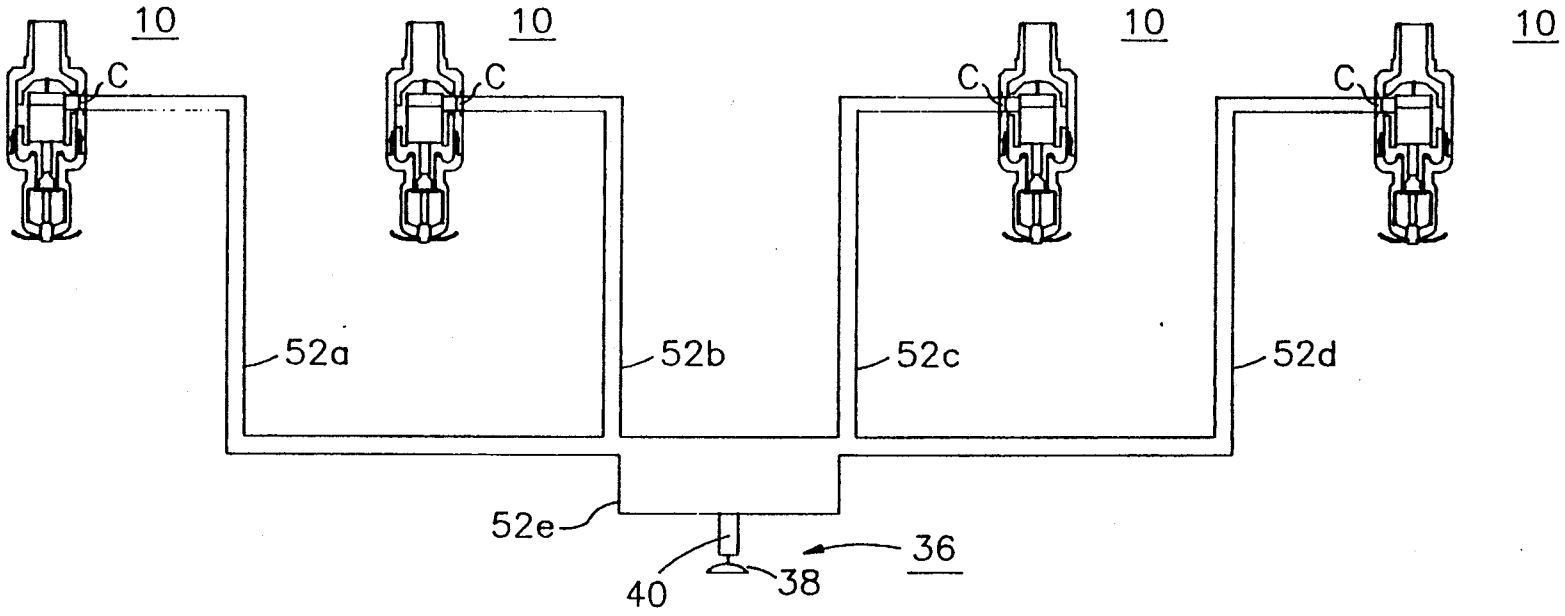
FIG. 10 is a diagrammatic view showing still another embodiment of the present invention wherein a plurality of on-off sprinkler devices of the type shown, for example, in FIG. 1 are controlled by a single heat sensor assembly.

FIG. 10 shows still another embodiment of the present invention in which a plurality of on-off sprinkler devices 10 (or 10', if desired, or a combination thereof) are controlled by a single heat sensor assembly 40 which simultaneously opens and closes the control openings C of the on-off sprinkler devices 10. Heat sensor 40 is directly coupled to each of the control openings by conduits 52*a*–52*d* all of which are coupled to a common outlet 52*e* to which the heat sensor assembly 36 is mounted. Such an arrangement enables the heat sensor assembly to be judiciously located at some critical point so that when the ambient temperature reaches an emergency level, two or more on-off sprinkler devices are operated simultaneously through the employment of a single control assembly 36. The operation of the devices shown in FIG. 10 are otherwise the same as those described in connection with FIGS. 7*a*–7*c* and 8.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A sprinkler apparatus comprising:

a housing having an inlet opening, an outlet opening, and an intermediate region communicating said inlet opening with said outlet opening;

a reciprocating member mounted within said intermediate region and movable between a first position sealing said outlet opening and a second position displaced from said outlet opening;

a control opening communicating with said intermediate region; and sensing means having a first condition normally sealing said control opening and a second condition unsealing said control opening responsive to a predetermined external condition;

said intermediate region having first and second fluid passageways to respectively deliver fluid entering said inlet opening to exert fluid pressure against an upper and a lower surface of said reciprocating member, said upper surface being adjacent said inlet opening and said lower surface being adjacent said outlet opening;

said control opening, when unsealed, enabling fluid contacting the upper surface of said reciprocating member to be diverted to and through said control opening reducing the fluid pressure applied to said upper surface at a flow rate greater than a flow rate through said first passageway enabling said fluid pressure exerted on the lower surface of the reciprocating member adjacent said outlet opening to move said reciprocating member to said second position;

a portion of said intermediate region having a cross-sectional configuration conforming to an outer periphery of said reciprocating member;

a gap space region provided between the outer periphery of said reciprocating member and a conforming interior surface of said intermediate region being of a tight tolerance sufficient to prevent fluid flow in said gap space region while permitting said reciprocating member to move from said first position toward said second position responsive to a minimal fluid pressure necessary to open the sprinkler apparatus.

2. The sprinkler apparatus of claim 1 wherein said minimal fluid pressure is less than ten psi.

3. The sprinkler apparatus of claim 2 wherein said minimal fluid pressure is less than five psi.

4. The sprinkler apparatus of claim 3 wherein said minimal fluid pressure is at least as small as three psi.

5. The sprinkler apparatus of claim 1 wherein the tolerance is in a range from 0.0001 to 0.0030 inches.

6. The sprinkler apparatus of claim 1 wherein the tolerance is selected to prevent fluid from flowing through the gap region between the outer periphery of said reciprocating member and the interior surface of said intermediate region.

7. The sprinkler apparatus of claim 1 further comprising biasing means for applying a light force upon said reciprocating member normally urging said reciprocating member toward said first position.

8. The sprinkler apparatus of claim 7 wherein said biasing means is a spring applying a spring force such that a reciprocating member force and a weight of the reciprocating member require no greater than an opening force of three (3) psi.

9. The sprinkler apparatus of claim 1 wherein said portion of said intermediate region comprises an insert fixedly positioned within said intermediate region and including means for slidably receiving said reciprocating member;

a first end of said insert preventing the fluid entering said inlet opening from engaging the upper surface of said reciprocating member adjacent said inlet opening;

said first passageway comprising a restricted opening being provided in said insert first end enabling the fluid entering said inlet opening to apply pressure to the upper surface of said reciprocating member adjacent said inlet opening.

10. The sprinkler apparatus of claim 9 wherein the relationship between a size of the restricted opening in said insert and the control opening is such as to prevent fluid inside said insert from being replenished when the control opening is open.

11. The sprinkler apparatus of claim 9 wherein said insert has an outer periphery provided with surface portions spaced from an interior region of said housing to define one of said first and second fluid passageways enabling fluid entering said inlet opening to move from said inlet opening toward said outlet opening through said fluid passageways to apply pressure to the lower surface of said reciprocating member confronting said outlet opening.

12. The sprinkler apparatus of claim 11 wherein the housing interior region receiving said insert has a substantially cylindrical wall surface for receiving said insert.

13. The sprinkler apparatus of claim 12 wherein said insert outer periphery is defined by a plurality of interspersed curved surface portions and flat surface portions arranged at equispaced intervals said flat surface portions cooperating with said housing interior region to define said second passageways.

14. The sprinkler apparatus of claim 12 wherein the cylindrical wall surface of said housing interior is provided with a plurality of recesses which cooperate with the outer periphery of said insert to define said second passageway.

15. The sprinkler apparatus of claim 9 wherein said insert is provided with a bushing having an interior surface with a low coefficient of sliding friction and cooperating with said reciprocating member to facilitate slidable movement of said reciprocating member relative to said bushing.

16. The sprinkler apparatus of claim 15 wherein said bushing is formed of a material taken from the group consisting of polytetrafluoroethylene, ceramic, and a plastic material chosen to provide low friction, corrosion resistance, and an ability to withstand high temperatures.

17. The sprinkler apparatus of claim 1 wherein said outlet opening is provided with a reciprocating member seat for seating the lower surface of said reciprocating member adjacent said outlet opening; and O-ring means is arranged between said reciprocating member seat and the lower surface of said reciprocating member for enhancing a fluid-tight seal therebetween when said reciprocating member is in said first position.

18. The sprinkler apparatus of claim 17 wherein said O-ring means is a resilient O-ring and is mounted upon said reciprocating member seat.

19. The sprinkler apparatus of claim 17 wherein said O-ring means is a resilient O-ring and is mounted upon said reciprocating member.

20. The sprinkler apparatus of claim 1 wherein said reciprocating member is a spherical-shaped member.

21. The sprinkler apparatus of claim 1 wherein said reciprocating member is a substantially cylindrical-shaped member having substantially flat end surfaces respectively defining said upper and lower surfaces.

22. The sprinkler apparatus of claim 21 wherein a surface area of said upper surface is greater than a surface area of said lower surface.

23. The sprinkler apparatus of claim 22 wherein the reciprocating member has an upper end of a first diameter and a lower end of a second diameter less than said first diameter defining a shoulder therebetween.

24. The sprinkler apparatus of claim 23 wherein an interior region of said housing slidably receiving said reciprocating member has a shape conforming to said reciprocating member.

25. The sprinkler apparatus of claim 1 wherein said reciprocating member is a member having a non-circular cross section with substantially flat end surfaces respectively defining said upper and lower surfaces.

26. The sprinkler apparatus of claim 1 wherein said sensing means comprises means for sensing an elevated temperature, and means for normally sealing said control opening and for unsealing said control opening when a predetermined temperature level is sensed.

27. The sprinkler apparatus of claim 1 wherein said reciprocating member is formed of a material taken from the group consisting of polytetrafluoroethylene, ceramic, and a plastic material chosen to provide low friction, corrosion resistance, and an ability to withstand high temperatures.

28. The sprinkler apparatus of claim 1 further comprising a normally closed sprinkler head coupled to said outlet opening for emitting a fluid passing through said outlet opening as a spray when the sprinkler apparatus is activated; and a space bar operating as a blocking piece arranged between said reciprocating member and the sprinkler head;

said space bar preventing said reciprocating member from moving to said first position prior to actuation of said sprinkler head.

29. The sprinkler apparatus of claim 23 wherein said sprinkler head further comprises a temperature sensitive means for opening the sprinkler head when an alarm temperature is reached and which prevents said reciprocating member from reclosing until said sprinkler head is opened.

30. The sprinkler apparatus of claim 1 wherein said housing is positioned so that said reciprocating member is oriented substantially in a vertical direction with said outlet opening being positioned substantially beneath said inlet opening, whereby normal gravitational force assists in moving the reciprocating member toward said first position when said control opening is sealed.

* * * * *